United States Patent [19]

Manzelli

[11] Patent Number: 4,715,158

[45] Date of Patent: Dec. 29, 1987

[54] MODULAR ELEMENT PARTICULARLY FOR FALSE CEILINGS, PARTITION SURFACES AND NON-STRUCTURAL WALLS

[76] Inventor: Giorgio Manzelli, Via S. Gallo 18, Lido Di Venezia (Province of Venezia), Italy

[21] Appl. No.: 872,331

[22] Filed: Jun. 9, 1986

[30] Foreign Application Priority Data

Jun. 14, 1985 [IT] Italy ..... 30725/85[U]

[51] Int. Cl.[4] ..... E04C 2/42

[52] U.S. Cl. ..... 52/581; 52/663

[58] Field of Search ..... 52/507, 663, 581, 590, 52/582

[56] References Cited

U.S. PATENT DOCUMENTS

| | | | |
|---|---|---|---|
| 910,801 | 1/1909 | Eggers | 52/590 |
| 2,900,495 | 8/1959 | Zwick | 52/507 |
| 4,454,698 | 6/1984 | Manzelli | 52/581 |

*Primary Examiner*—James L. Ridgill, Jr.

*Attorney, Agent, or Firm*—Guido Modiano; Albert Josif

[57] ABSTRACT

This modular element is particular suitable for equipping false ceilings, partition surfaces and non-structural walls in general. The element comprises a main body having, on its outer surface a pair of male connection elements and a corresponding pair of countershaped female connection elements. Each of the male connection elements comprises a flat ribbing extending from the outer surface of the main body and has, on an edge thereof opposite to the outer face, a substantially cylindrical enlargement, while each of the female connection elements comprises a tubular lug having its longitudinal axis parallel to the enlargement of the male connection element. The lug of the female connection element, on a side thereof opposite to the outer surface has a longitudinal slit extending from an open end of the lug for accommodating the ribbing of an adjacent modular element.

8 Claims, 5 Drawing Figures

MODULAR ELEMENT PARTICULARLY FOR FALSE CEILINGS, PARTITION SURFACES AND NON-STRUCTURAL WALLS

BACKGROUND OF THE INVENTION

This invention relates to a modular element particularly for false ceilings, partition surfaces and non-structural walls.

SUMMARY OF THE INVENTION

It is the task of this invention to provide a modular element having high functional characteristics and, despite its very simple structure, a particular system of mutual engagement which allows quick and secure interconnection of a plurality of such elements, so as to be validly employed in making flat surfaces with varying contours and extensions.

It is a particular object of the invention to provide a one-piece construction modular element which requires for combination no other separate joining means and which is particularly suitable for fabrication in relatively small sizes.

An important object is to provide a modular element which can be produced from variously colored materials and having different characteristics of optical transparency, so as to enable obtainment of surfaces having novel chromatic effects, such as figuring or other ornamental or decorative well detailed patterns.

Another consequent object is to afford fabrication of walls, e.g. partition or covering walls, which have a lower or increased space separation effect respectively dependent on its resulting from joining more or less transparent and colored modules together.

A not least object of this invention is to provide a false ceiling formed by modular elements which may be easily obtained on ordinary usual equipments and are highly moderate in cost so as to be competitive from an economical standpoint.

The above outlined aim and objects are achieved by a modular element particularly for equipping false ceilings, partition surfaces and non-structural walls comprising a main body having, on its outer surface, a pair of male connection elements and a corresponding pair of countershaped female connection elements,characterized in that each of said male connection elements comprises a ribbing extending from said outer surface and has, on an edge thereof opposite to said outer surface, a substantially cylindrical enlargement, each of said female connection elements comprising a substantially tubular lug having its longitudinal axis parallel to said enlargement, said lug having, on a side thereof opposite to said outer surface, a longitudinal slit extending from an open end of said lug.

BRIEF DESCRIPTION OF THE DRAWINGS

Further features and advantages will be more clearly apparent from the detailed description of a modular element according to the invention, shown by way of illustration in the accompanying drawings, where.

DESCRIPTION OF THE PREFERRED EMBODIMENT

Figure 1:
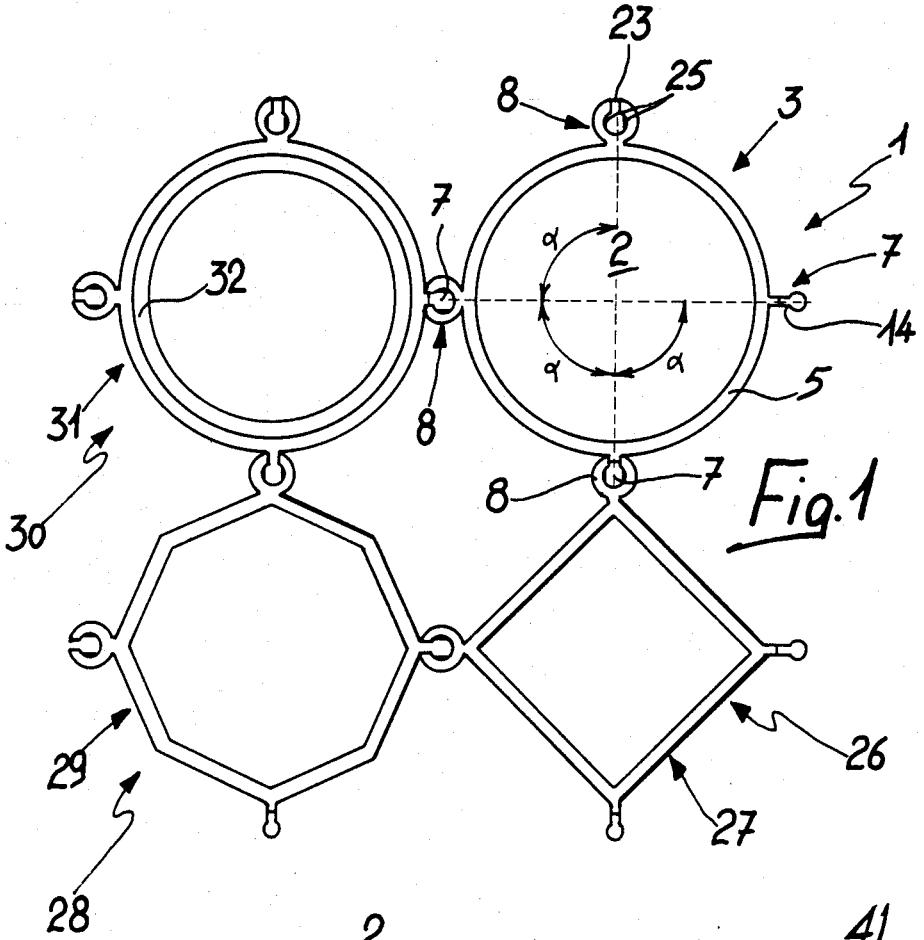
FIG. 1 is a plan view of four interconnected modular elements, each with different geometric characteristics.

With reference to the drawing figures, a modular element generally indicated at 1, comprises a main body 2 which is composed of a tubular portion 3, for example with a circular cross-section, which has a first base 4 and a second base 5 parallel to each other and being both orthogonal to the main axis of the tubular portion 3.

The tubular portion 3 has an outer surface 6, for example substantially cylindrical, defining a pair of male connection elements 7 and a pair of female connection elements 8 projecting therefrom.

Advantageously the connection elements 7 and 8 are equidistant from each other, at an angle or enlarged portion of substantially 90°, and each male connection element 7 extends in a diametrically opposite direction to a female connection element 8.

Figure 4:
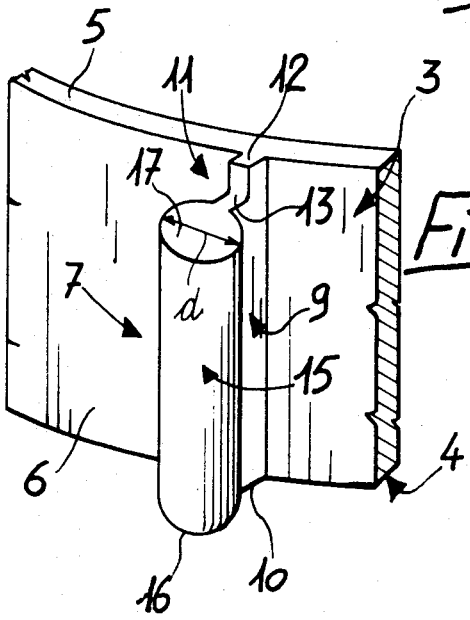
FIG. 4 is a fragmentary perspective view of a modular element showing a male connection element.

Each male connection element 7, as shown best in FIG. 4, comprises a flat ribbing 9 which extends radially from the outer surface 6 and has a first edge 10 parallel and substantially aligned to the first base 4, and a second edge 11 comprising a first inner section 12 parallel and aligned to the second base 5 and a second outer section 13 which is bent and depressed with respect to the second base 5. On the longitudinal edge 14, remote from the outer surface 6, of the ribbing 9 a substantially cylindrical enlargement or enlarged portion 15 is formed, defining an enlarged portion length $l_1$ and a longitudinal axis 41 which is suitably parallel to the main axis or central symmetry axis 40 of the tubular portion 3.

Advantageously, at the first edge 10, the enlargement 15 forms a rounded end 16 whereas, on the opposite side, at the second edge 11, a flat end or engagement end surface 17 is formed which, as visible, extends at a distance from the first main body base 4 which is equal to the length 1. As visible, the surface 17 extends substantially perpendicular to the longitudinal axis 41 and has a transverse dimension d.

Figure 2:
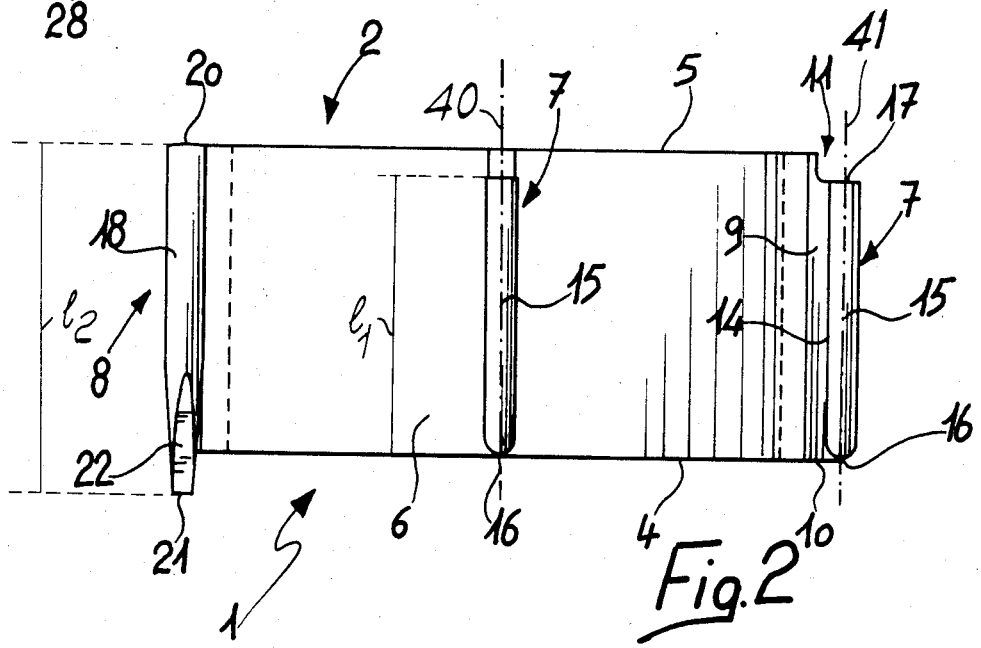
FIG. 2 is a first side view of a modular element.
Figure 3:
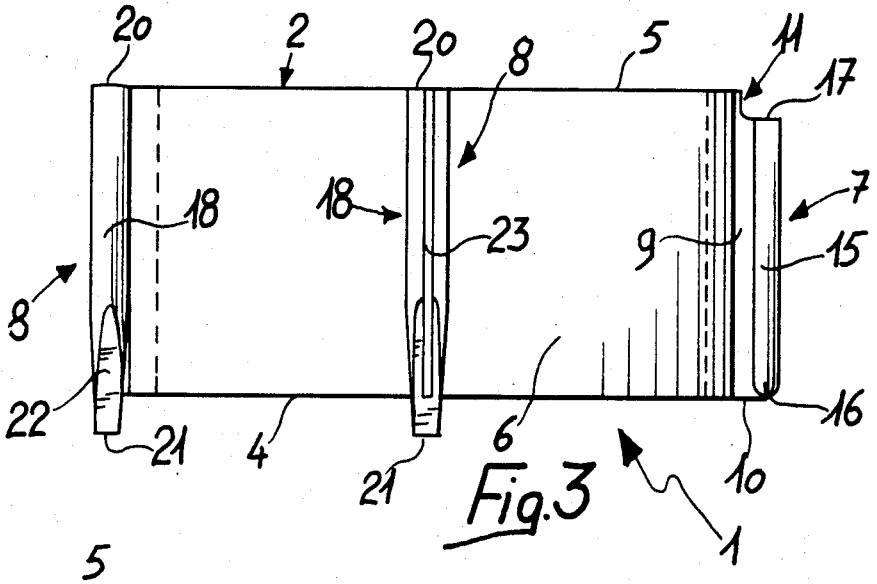
FIG. 3 is a second view of a modular element.
Figure 5:
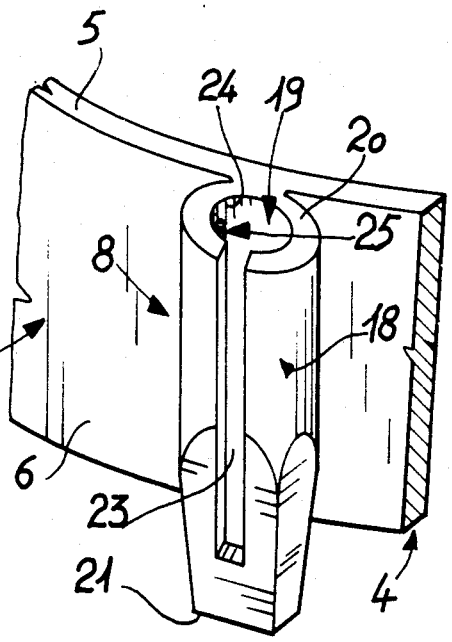
FIG. 5 is a fragmentary perspective view of a modular element showing a female connection element.

Each female connection element, as shown in more detail in FIG. 5, is composed of a substantially tubular lug 18, suitably arranged with its longitudinal axis parallel to the cylindrical enlargements 15 and having a length $l_2$ which, as visible, is higher than the length $l_1$ of the enlargement 15. The lug 18, which defines on its interior a cavity forming a seat 19 for insertion of a countershaped male connection element belonging to an adjacent modular element, has an open end 20 advantageously parallel and in alignment with the second base 5 of the tubular portion 3, and on the opposite side, a closed end 21 which protrudes from the plane defined by the first base 4. As visible from FIGS. 2 and 3, the lug 18 has a length which is greater than the enlarged portion 15.

More in detail, it should be pointed out, that the lug 18, on the side opposite to the open end 20, is tapered externally with sloping faces 22 which converge toward the closed end 21 thereby imparting to the closed end 21 an outer polygonal contour, for example a quadrangular one.

According to the invention, the lug 18 has, on the side diametrically opposite to the outer surface 6 of the tubular portion 3, a longitudinal slit 23 which extends from the open end 20 toward the closed end 21 at least as far as the same level of the first edge 10 which, in this specific case, coincides with that of the first base 4.

It should be also taken into account that, in the proximity of the open end 20, the lateral wall 24 of the seat 19 defines stop elevations or projections suitably formed of a pair of rounded elevations 25 which protrude slightly toward the inside of the seat 19 close to the second main body base 5.

Also within the scope of this invention it is easily possible to introduce modifications, concerning for example the shape of the main body 2, as described, for the purpose, for example, of changing the outward appearance taken by the modular elements and hence of the whole wall as well as to modify the overall effect of separation and transparency afforded by the wall, adjusting it for the specific use.

Thus, FIG. 1 shows four embodiments of the modular element which, in relation to the particular shape of the main body, can be particularly advantageous and are equally effective; in particular the reference numeral 26 indicates a modular element the main body whereof is composed of a tubular prismatic portion 27 with quadrangular cross-section, whilst the numeral 28 designates a modular element which has a different tubular prismatic portion 29 with octagonal cross-section.

Advantageously, in both modular elements 26 and 28, the male and female connection elements extend from the outer vertices of the respective tubular prismatic portions, 27 and 29, and each male element is arranged, with respect to the main axis of the prismatic portion, symmetrically of a corresponding female element present on the opposite vertex.

And again, with the numeral 30, there has been designated a modular element the main body 31 whereof has, at one of the bases, a bevel which originates an inclined annulus 32, for example, sloping inwardly.

The tubular elements may be closed internally by a bottom or an inner septum, having a flat or any other desired shape; such closure elements may be manufactured at the same time of the main body and thereby fixed with the latter or attached to the modular elements subsequently to their production, and completely or partly shut off the central hole of the tubular elements, possibly by projecting outwardly of their bases.

From what has been described the use of the combined modular elements according to the invention may be summarized as follows.

The combined elements are used, by connecting them regularly side-by-side along mutually perpendicular directions so as to form a wall or another surface of any size.

The rounded end 16 of the male connection elements 7 is inserted into the open end 20 of the female connection elements 8 of an adjacent modular element; the rounded end 16, on engaging with the rounded elevations 25, by virtue of the stop projections or elevation 25 defining with each other a mutual distance which is smaller than the width of enlarged portion 15, thereby restricting the cross-sectional dimension of the seat 19, brings about a slight elastic deformation of the lug 18 to permit the insertion into the seat 19 of the whole enlargement 15, causing the ribbing 9 to slide in the longitudinal slit 23.

The enlargement 15 is pushed into the seat 19 until the flat end 17, being at the distance $l_1$ from the main body lower base 4 which, obviously, is lower than the distance of the projections 25 from the same lower base 4, and by moving past the rounded elevations 25, by virtue of the mutual distance of the stop elevations 25 being smaller than the transverse dimension d of the surface 17 allows the lug 18 to return elastically to the indeformed rest position while the elevations 25 engage with the flat end 17.

Likewise, to the female connection elements 8 of each individual modular element 1 there may be connected the corresponding male connection elements 7 of the adjacent modular elements.

The presence of the rounded elevations 25, among others, is advantageous since, for the separation of the modules, a relatively high initial effort should be applied capable of again deforming the lug 18, thereby preventing accidental slipping off; on the other hand it is still possible to effect separation of the connection and moreover, as may be easily inferred, the particular arrangement of the connection elements, with male connection elements 7 and female connection elements 8 arranged on the opposite side from the main body 2, makes it possible to divide the panels into two or more parts along parallel lines to the alignment of the modular elements 1.

It has been found in practice that the modular elements according to the invention lend well to quick combination of non-structural surfaces, such as false ceilings, partition walls or covering walls, etc. without any constructional or assembly complications.

The high rigidity taken by the assembly, while combined with considerable lightweight in particular with modular elements made of a suitable plastic material, ensures a high reliability also in the preparation even of a large size surfaces without any difficulties.

It should be also pointed out that the modular elements described, which lends themselves well for fabrication with normal manufacturing techniques, for example, by molding from a plastic material, may be made indifferently from both an opaque and transparent material as well as a translucid one in an unlimited range of colors and hues for the purpose of adjusting its chromatic effect to an unlimited number of possible uses.

Thus, merely as an example, it will be possible to use opaque elements of a dark color, which may possibly have a closed main body 2, to emphasize an effect of space separation, or to use transparent or translucid modules in walls through which a large amount of light is sought; it will be possible in the latter application to use, for example, colored transparent elements thereby the light may cause new and particular coloring effects.

As is clearly apparent, in addition to preparation of false ceilings, walls, etc. in a single color, with the use of variously colored modular elements, the composition is made possible of surfaces with differently colored areas distinctly separated from one another.

It will be possible in this manner, for example, to obtain new chromatic compositions or new decorative and ornamental effects.

The described possibility of taking varying coloring and transparency combined with the fact that the described modular elements are particularly suitable for production in relatively small sizes, brings about as a consequent further advantage the possibility of obtaining patterns or chromatic compositions in general which are much detailed.

Thus it will be possible to make surfaces with very accurate figuring, or much detailed ornamental decorations, and also shelves on which there are brought out wordings, symbolic indications or many other new effects among which those mentioned are only related for illustrative purposes.

It will be apparent that the possibility of obtaining in the manner described detailed figuring can find varying highly interesting applications, in addition to the already reiterated preparation of partition walls and false ceilings, in the composition of moldings, signs, backdrops, wings, scenaries and others yet, all obtained, by virtue of the particular system of interconnection, utilizing the possibility of employing transparent or opaque modules in different colors from one another.

In relation to the ample freedom in the definition of the shape of the main body. allowed by the absence of links imposed by the connection system, particularly advantageous is the use of tubular shapes, both internally closed and open, which, in addition to a beneficial structural influence, well combining with the appearance taken by the connection elements, bring about a specific aesthetic appearance due to the regular alternation of like forms with different dimensions so as to lead to an appealing and proportioned overall result.

Even if a particular attention may be devoted to the use of plastic materials, in practice the materials used, as well as the dimensions, may be any ones according to necessity.

I claim:

1. A modular element, particularly for equipping false ceilings, partition surfaces and non-structural walls, comprising a main body defining a first and a second main body bases, opposed to each other, and an outer side surface extending between said main body bases, a pair of male connection elements and a correspondent pair of female connection elements protruding from said outer side surface at mutually opposed locations thereof, each of said male connection elements comprising a ribbing extending from said outer side surface between said main body bases and having, on an edge thereof opposite to said outer side surface, an enlarged portion having an engagement end surface facing said first main body base, defining a transverse dimension and and extending at a first distance from said second main body base, each of said female connection elements comprising a sustantially tubular lug protruding from said outer side surface between said main body bases, said lug having an open end portion facing said first base and an internal cavity extending from said open end portion through said lug, said internal cavity being substantially countershaped to said enlarged portion, said lug further having a longitudinal slit extending at a lateral side of said lug opposed to said outer side surface and communicating with said cavity and stop projections extending in said internal cavity at a second distance from said second main body base which is greater than said first distance, said stop projections defining a mutual distance which is smaller than said transverse dimension, thereby, after insertion of said enlarged portion of said male connection element in an internal cavity of a female connection element of adjacent modular elements, the stop projections of the female connection element of the adjacent modular elements cooperating with said engagement end surface of said enlarged portion and securely retaining said enlarged portion in the internal cavity.

2. A modular element, particularly for equipping false ceilings, partition surfaces and non-structural walls, comprising a main body defining a first and a second main body bases, opposed to each other, and an outer side surface extending between said main body bases, a pair of male connection elements and a correspondent pair of female connection elements protruding from said outer side surface at mutually opposed locations thereof, each of said male connection elements comprising a ribbing extending from said outer side surface between said main body bases and having, on an edge thereof opposite to said outer side surface, an enlarged portion defining an enlarged portion length and having an engagement end surface defining a transverse dimension and facing said first main body base, each of said female connection elements comprising a sustantially tubular lug protruding from said outer side surface between said main body bases, said lug having a length greater than said enlarged portion length, an open end portion facing said first base and an internal cavity extending from said open end portion through said lug, said internal cavity being substantially countershaped to said enlarged portion, said lug further having a longitudinal slit extending at a lateral side of said lug opposed to said outer side surface and communicating with said cavity and stop projections extending in said internal cavity close to said first main body base, said stop projections defining a mutual distance which is smaller than said transverse dimension, thereby, after insertion of said enlarged portion of said male connection element in an internal cavity of a female connection element of adjacent modular elements, the stop projections of the female connection element of the adjacent modular elements cooperating with said engagement end surface of said enlarged portion and securely retaining said enlarged portion in the internal cavity.

3. A modular element, particularly for equipping false ceilings, partition surfaces and non-structural walls, comprising a main body defining a first and a second main body bases, opposed to each other, and an outer side surface extending between said main body bases, a pair of male connection elements and a correspondent pair of female connection elements protruding from said outer side surface at mutually opposed locations thereof, each of said male connection elements comprising a ribbing extending from said outer side surface between said main body bases and having, on an edge thereof opposite to said outer side surface, an enlarged portion defining a longitudinal axis and an enlarged portion length and having an engagement end surface extending substantially perpendicular to said longitudinal axis and facing said first main body base, said engagement end surface defining a transverse dimension, each of said female connection elements comprising a sustantially tubular lug protruding from said outer side surface between said main body bases and extending parallel to said longitudinal axis, said lug having a length greater than said enlarged portion length, an open end portion facing said first base and an internal cavity extending from said open end portion through said lug, said internal cavity being substantially countershaped to said enlarged portion, said lug further having a longitudinal slit extending at a lateral side of said lug opposed to said outer side surface and communicating with said cavity and stop projections extending in said internal cavity close to said first main body base, said stop projections defining a mutual distance which is smaller than said transverse dimension, thereby, after insertion of said enlarged portion of said male connection element in an internal cavity of a female connection element of adjacent modular elements, the stop projections of the female connection element of the adjacent modular elements cooperating with said engagement end surface of said enlarged portion and securely retaining said enlarged portion in the internal cavity.

4. A modular element according to claim 3, wherein said main body comprises a tubular portion defining a central symmetry axis parallel to said longitudinal axis, said male connection elements extending at 90° from each other and diametrically to said female connection elements.

5. A modular element according to claim 3, wherein said main body comprises a prismatic portion defining a central axis substantially parallel to said longitudinal axis, each said male connection element extending opposite to one of said female connection element with respect to said central axis.

6. A modular element according to claim 5, wherein said connection elements extend from opposite vertices of said prismatic portion.

7. A modular element according to claim 3, wherein said ribbing has a first end edge facing said second main body base and a second end edge, opposite to said first end edge, facing said first main body base and at least partially depressed thereto, and said lug has said open end portion defining an end surface facing said first main body base and an opposed closed end portion facing said second main body base, said longitudinal slit of said lug extending at least as far as said first end edge of said ribbing.

8. A modular element according to claim 7, wherein said first end edge is parallel to said second main body base, said end surface of said open end portion is parallel to and level with said first main body base and said opposed closed end portion defines a closed end surface parallel to said second main body base.

* * * * *